US006354207B1

(12) United States Patent
Maekawa et al.

(10) Patent No.: US 6,354,207 B1
(45) Date of Patent: Mar. 12, 2002

(54) SOLID INK PRINTING MASTER PLATE AND METHOD FOR PREPARING THE SAME

(75) Inventors: Tsutomu Maekawa; Akemi Ouchi; Atsushi Kakuta, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/494,377

(22) Filed: Jan. 31, 2000

(30) Foreign Application Priority Data

Jan. 29, 1999 (JP) ..... 11-021631

(51) Int. Cl.[7] ..... B41N 1/14
(52) U.S. Cl. ..... 101/453; 101/466
(58) Field of Search ..... 101/457, 462, 101/463.1, 465–467, 453; 347/88, 99, 105

(56) References Cited

U.S. PATENT DOCUMENTS 3,741,115 A * 6/1973 Keller ..... 101/350.1
3,779,771 A * 12/1973 Gatzke ..... 430/514
4,833,486 A * 5/1989 Zerillo ..... 101/466
5,354,368 A * 10/1994 Larson, Jr. ..... 347/99
5,669,965 A * 9/1997 Sawada et al. ..... 106/31.29
5,820,932 A * 10/1998 Hallman et al. ..... 101/463.1
5,852,975 A * 12/1998 Miyabe et al. ..... 101/463.1
6,019,045 A * 2/2000 Kato et al. ..... 101/466
6,173,647 B1 * 1/2001 Kakuta et al. ..... 101/466
6,187,380 B1 * 2/2001 Hallman et al. ..... 101/463.1

FOREIGN PATENT DOCUMENTS

JP 64-27953 1/1989
JP 4-117468 4/1992

* cited by examiner

*Primary Examiner*—Stephen R. Funk
(74) *Attorney, Agent, or Firm*—McGinn & Gibb, PLLC

(57) ABSTRACT

When a solid ink printing master plate is constructed by liquefying by heating an ink composition which exists as a solid at room temperature, imparting some jet energy thereto thereby jetting out ink droplets, and then fixing the thus spattering ink droplets onto a substrate, the adhesion strength between the ink composition and the substrate is controlled to 25 g/mm$^2$ or more.

19 Claims, 3 Drawing Sheets

SOLID INK PRINTING MASTER PLATE AND METHOD FOR PREPARING THE SAME

BACKGROUND OF THE INVENTION

1. Technical Field of the Invention

This invention relates to a printing master plate with the use of an ink composition which exists as a solid at ordinary temperature (hereinafter referred to as solid ink) and a device for providing a printing master plate.

2. Description of the Related Art

A photoengraving method is the well-known method for providing printing master plates. In the method, a mask, etc. is formed based on a block copy or a photographic negative (a gathered plate) and then an engraving plate is formed. Based on the engraving plate, proof is performed and a printing master plate (a printing plate) is formed followed by printing.

On the other hand, it is sometimes observed in recent years to employ a DTP (Desk Top Publishing) method wherein the formation of an engraving plate has been digitized. In this method, data including characters, figures images, etc. are output (by laser beam-exposure, etc.) from a computer provided with a built-in memory to form an engraving plate which is then subjected to proof, printing plate-formation and printing as in the conventional case. Use of this method makes it unnecessary to newly form a block copy in the step of proof, thus simplifying the process.

To further simplify the process, there has been developed a method called CTP (Computer to Plate) wherein the printing plate-formation has been digitized. In this method, namely, not only the proof procedures but also various image processing treatments can be efficiently carried out. In this case, it is the most desirable to directly form a printing master plate without resort to any chemical or physical processing.

As printing plate substrates, there have been employed a number of products provided with various photosensitive material layers formed on the surface. Examples thereof include silver halide photosensitive materials (silver salt photographic plates), diazo photosensitive material (PS (Presensitized) plates) and photoconductive materials (electrophotographic plates). In these cases, various chemical and physical post-treatments are needed after exposure for development and fixation. In contrast thereto, there has been also known a processing-free print plating method wherein a surface layer made of silicone rubber is formed and, after exposure, the protective layer is separated to thereby form a printing plate without using water. Although these methods have been already put into practical use over a wide range, complicated processing steps are required in each case. Therefore, it has been urgently required to develop a method whereby a printing plate can be more quickly formed. The above matters are described in detail in, for example, "Insatsu Kogaku Binran (Printing Technology Handbook)", edited by Japan Society of Printing Science, Gihodo Shuppan (1987).

As methods for the direct formation of printing plates, there have been recently developed the electrophotographic transfer method (xerography method) and the liquid ink jet method. In the electrophotographic transfer method, a toner image formed on a photosensitive drum is transferred onto a printing plate substrate to thereby form a printing plate conveniently and quickly. However, this method suffers from a problem that a large-sized plate highly useful in practice (for example, A2 size or larger) can be hardly formed thereby because of the constitution of the device. Moreover, it is unavoidable from the principle that a small amount of fine toner grains spatter onto the background in the transfer step, which often results in a problem in the actual printing process.

On the other hand, the liquid ink jet system is a convenient method by which a large-sized printing plate can be directly obtained. When an aqueous medium is employed, however, there frequently arises a problem that ink to be printed is repelled by the image of the liquid ink formed on the printing plate upon coating the printing plate with the ink to be printed. This is because resinous components generally have highly hydrophilic nature in many cases. In this case, it is furthermore needed to subject the printing plate substrate to a specific pretreatment so as to prevent the print dots from spreading. Although these problems are somewhat relieved in the case of inks containing organic solvents, there are several serious problems in common to these ink jet systems such that a drying step is needed, that the type and fixation level of resins are limited, and that the printing plate thus obtained has only a short printing life. A number of reports have been made on the application of the ink jet method to engraving or printing plate formation, for example, JP-A-51-84303, JP-A-54-94901, JP-A-56-62157, JP-A-56-113456, JP-A-60-245587, JP-A-62-25081, JP-A-62-62157, JP-A-63-102936, JP-A-63-109052, JP-A-4-69244, JP-A-4-69245, JP-A-4-282249, JP-A-4-317065, JP-A-5-204138, JP-A-5-269958, JP-A-8-324145 and JP-B-58-8991 (the term "JP-A" as used herein means an "unexamined published Japanese patent application, while the term "JP-B" as used herein means an "examined Japanese patent publication").

To cope with these problems, JP-A-64-27953 discloses a solid ink jet recording method and a device therefor wherein an image forming agent which exists as a solid at room temperature (i.e., a solid ink) prepared from natural wax, etc. is liquefied by heating and then jetted out toward a printing plate substrate followed by solidification, thus forming a printing plate. Since this method can be performed in a solvent-free system, many problems accompanying use of a solvent, as observed in the liquid ink jet system, can be overcome thereby. In addition, natural wax, etc. generally have hydrophobic nature and thus contribute to solve the problem that the ink to be printed is repelled by the image of the liquid ink formed on the printing plate upon coating the printing plate with the ink to be printed. Owing to these characteristics, this method is a highly effective one. In the patent cited above, however, the description is made not in detail but very generally. It is therefore highly difficult based on the description thereof to obtain a highly reliable printing plate having a long life which is to be actually used for forming a printing plate. Thus, experiments should be made in greater detail to improve the abrasion resistance, compatibility with ink, easiness in printing, printing qualities, etc. JP-A-52-20106 discloses a usual printing method with the use of a solid ink.

In general, an ink dot on a printing master plate with the use of a solid ink adheres to a substrate in the form of a hemisphere having a certain thickness just like a lens, which is adequate for uniformly separating the printing plate carrying such ink dots adhering thereto from a paper sheet. With attempts to minimize the ink dot size so as to establish a high clarity and a high resolution of printed images, the contact area between the ink dots and the substrate has been more and more reduced. As a result, there arises a problem that the existing inks are liable to peel off.

When ink dots are located closely to each other or overlap together to form a pattern, the ink cannot be well transferred at grooves between the hemispherical ink dots, thereby giving irregular printing.

In addition, there arises another problem that hemispherical ink dots having a certain thickness are gradually rubbed off from the surface and deformed. In its turn, the printed dot size is changed and the printing life and qualities are damaged.

SUMMARY OF THE INVENTION

An object of the present invention is to provide a solid ink printing plate by which the above-described problems encountered in the conventional art can be overcome and printing qualities can be improved in practice.

The gist of the present invention, which has been made to solve the above-described problems, resides in a solid ink printing master plate constructed by liquefying by heating an ink composition which exists as a solid at room temperature, imparting some jet energy thereto thereby jetting out ink droplets, and then fixing the thus spattering ink droplets onto a substrate, wherein the adhesion strength between the ink composition and the substrate is controlled to 25 g/mm$^2$ or more.

With respect to the physical properties of the ink composition as described above, it is preferable that the ink composition has no yield value in compression stress until the strain rate at room temperature attains 10%, or the compression stress at a strain rate of 10% is 10 kgf/cm$^2$ or more. It is still preferable that the ink composition has a penetration hardness at room temperature of 3 or more.

It is favorable in the present invention that the ink composition contains higher fatty acid esters and a plasticizer.

In the construction of the solid ink printing master plate according to the present invention, it is preferable that the melt viscosity of the ink composition in the step of jetting out the ink droplets is controlled to 5 to 30 mPa·s.

DETAILED DESCRIPTION OF THE PRESENT INVENTION

Figure 1A:
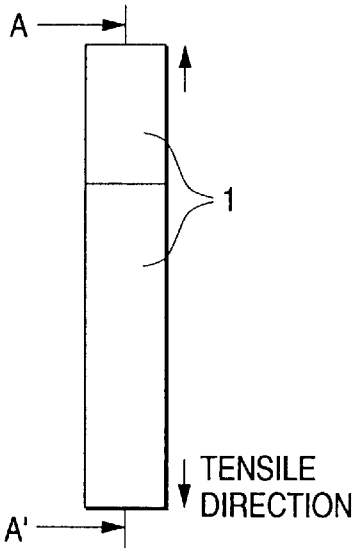
FIGS. 1A and 1B are a schematic plan view and a sectional view showing a tensile test sample employed in the present invention.

The present invention aims at providing a master plate mainly for offset printing (lithography, offset rotary press printing, etc.) and a device for providing the same. However, those skilled in the art will easily conceive to apply it to other printing systems (for example, relief printing, screen printing, flexo printing, gravure printing, etc.).

It is intended that a pulse pressurized ink jet system with use of the electrostriction of a piezoelectric element is mainly employed as a printing head for the solid ink according to the present invention. However, those skilled in the art will easily conceive to further employ other systems therefor, for example, a continuous ink jet system with use of the electrostriction of a piezoelectric element or a gassing thermal ink jet system.

The present inventors have conducted intensive studies to establish an optimum method for using a solid ink as a printing plate and thus completed the present invention. Namely, the present inventors have found that, in a method for providing a printing master plate by liquefying by heating an ink composition which exists as a solid at room temperature, imparting some jet energy thereto thereby jetting out ink droplets, and then fixing the thus spattering ink droplets onto a substrate, combined use of an ink composition and a substrate achieving an adhesion strength between them of 25 g/mm$^2$ or more makes it possible to prevent ink dots, even having a small size corresponding to an image of a high resolution of 300 dpi or more, from peeling off from the substrate.

In the present invention, the adhesion strength is measured by using the method shown in FIGS. 1 and 2. Namely, a test sample to be employed in measuring the adhesion strength to a printing sheet is prepared by inserting a solid ink, which has been molten by heating to around the ink jet temperature, between the printing sheets and then spontaneously solidified by cooling. When the substrate per se has a certain hardness as in the case of an aluminum plate, etc. and the solid ink and the printing plate material can be maintained in a stable state, the plate material is employed directly. When the substrate per se is unstable in the shape as in the case of a film plate, a paper plate, etc., on the other hand, the substrate is fixed onto a plate made of aluminum, stainless, etc. by using an adhesive, a pressure-sensitive adhesive double coated tape, etc and then a solid ink is inserted to thereby give a test sample. After the solidification of the solid ink, the test sample is allowed to stand at room temperature over a definite period of time and then employed in the measurement with the use of a tensile compression test device.

It is preferable that the ink composition has no yield value in compression stress until the strain rate at room temperature attains 10%, or the compression stress at a strain rate of 10% is 10 kgf/cm$^2$ or more. When such a requirement is satisfied, the plate pressure can be relieved owing to the deformation of ink dots per se in any printing pattern and thus the peeling-off of the ink dots can be avoided.

Figure 3:
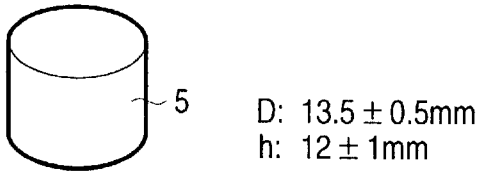
FIG. 3 is a schematic perspective view of an ink pellet employed in the compression evaluation test in the present invention.

As FIG. 3 shows, the compression stress is measured in the present invention by pouring the solid ink, having been once molten by heating, into a cylindrical metal mold, solidifying the same by spontaneously cooling to form an ink pellet (5) allowing it to stand at room temperature for a definite period of time, shaping it into a desired test sample by using sand paper, hot plate, etc. and then performing the measurement in a compression stress test device.

JP-A-4-117468 states concerning the abrasion resistance (rubbing resistance) of print and the shear strength of an ink. As a matter of course, it is also possible in the present invention to use a solid ink having a high shear strength. In the construction of a printing master plate for offset printing machine, however, consideration of some factors should take priority over the shear strength.

Figure 5:
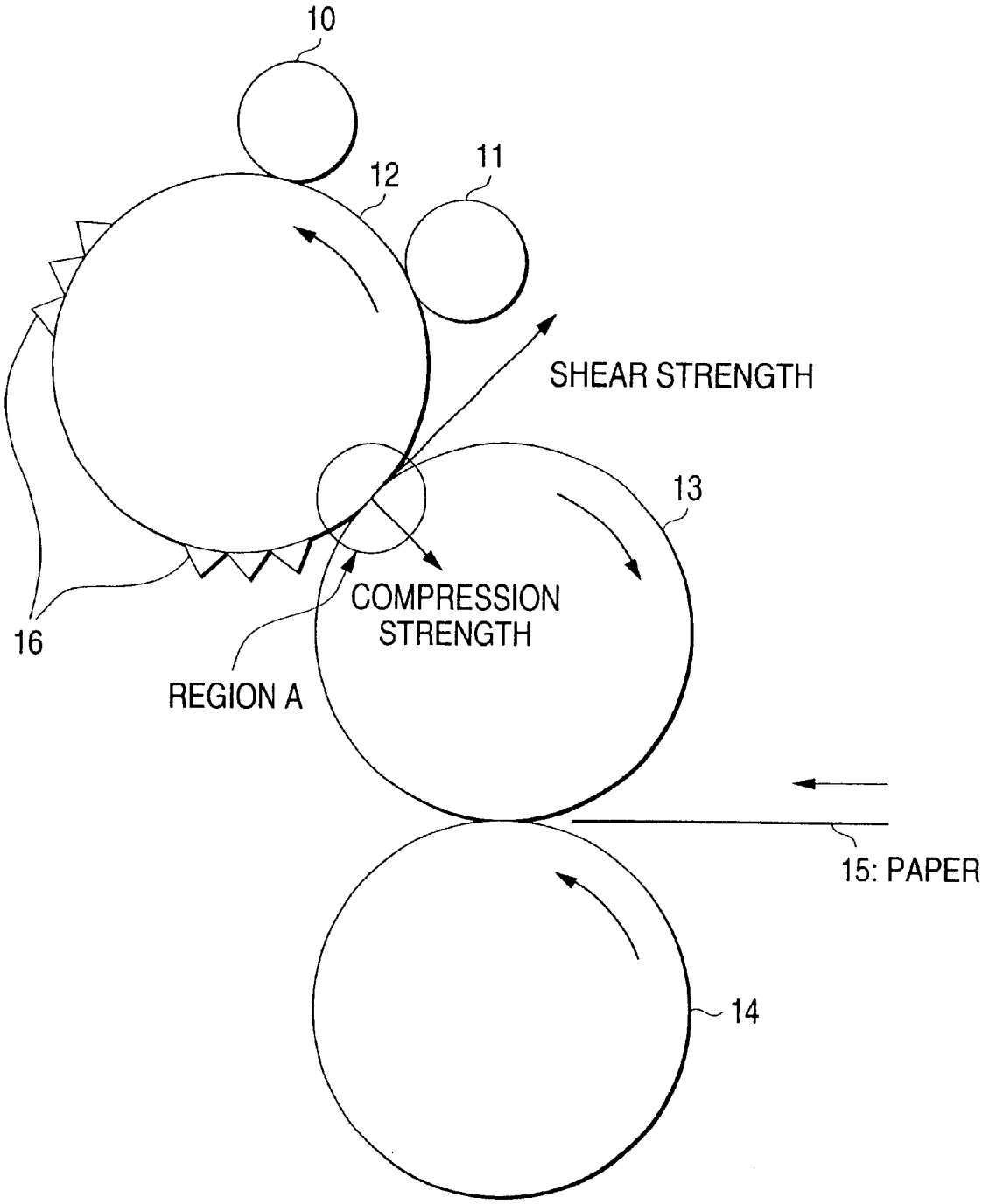
FIG. 5 is a schematic view of an offset printing machine.

FIG. 5 is a schematic view of an offset printing machine. In FIG. 5, numeral 10 denotes an ink roller; numeral 11 denotes water roller; numeral 12 denotes a twin drum roller on which the solid ink printing master plate is wound; numeral 13 denotes a blanket rubber roller; numeral 14 denotes a transfer roller; numeral 15 denotes a print sheet; and numeral 16 denotes solid inks which fixes on the substrate of the solid ink printing master plate.

In FIG. 5, the maximum pressure is applied to the solid ink printing master plate in the region (A) where the printing ink is transferred onto a blanket rubber roller. This pressure seemingly causes the peeling-off of the solid ink from the master plate. It is, therefore, considered that a more appropriate and favorable material can be selected by paying attention not to the shear strength which is a tangential strength but rather to the compression strength perpendicular thereto. Further, it is clarified that since there are solid ink projections on a solid ink printing master plate, the pressure is liable to be concentrated in the compression direction of the solid ink.

When ink dots are located closely to each other or overlap together to form a pattern, the ink cannot be well transferred at the grooves between the hemispherical ink dots, thereby giving irregular printing in some cases. To optimize the ink dot shape, it is also effective to deform ink dots by heating or pressurizing during or after printing or to preheat a substrate as stated in JP-A-1-127358, JP-2-561, JP-A-2-502175, JP-B-5-18716, JP-B-5-54826, JP-A-7-323539, etc., or to form an ink dot pattern once on another medium (transfer medium) followed by transfer onto a substrate for printing plate as stated in JP-A-6-206368, JP-A-6-293178, JP-A-7-168451, JP-A-7-276621, JP-7-508226, JP-A-5-200997, JP-A-6-143552, etc. However, these methods each results in an increase in the cost of the apparatus. In addition, there arise some restrictions in these cases in, for example, application to large-sized sheets and the material and thickness of the printing master plate.

Moreover, the present inventors have found out that a printing plate with the use of a solid ink having a penetration hardness of 3 or more as defined in JIS K2235 5,4 (1980), among various methods for evaluating hardness known so far, remarkably contributes to the improvement in printing qualities Namely, they confirm that when a solid ink having a penetration hardness of 3 or more is employed, hemispherical dots wear out while several ten sheets are printed to adjust the location of the substrate set on a printing machine and the amount of the ink. Thus, the grooves among the dots would not prevent the transfer of the printing onto the paper, thus causing no irregularity in printing. On the contrary, a solid ink having a penetration hardness less than 3 brings about deterioration in the printing qualities (irregularity, etc.) and thus cannot be used in practice, though the resultant printing plate scarcely wears out and thus has a long life.

The present inventors have further found out that use of a higher fatty acid ester or a plasticizer as an ink component effectively contributes to the improvement in the ink properties.

An ink containing a fatty acid ester has a low melt viscosity and a stable fluidity in a molten state. In addition, such an ink is superior in the flexibility and surface-protective power to those constituting of carbon-carbon bonds, which makes them durable to bending. It is preferable to use a fatty acid ester which has a penetration hardness of 3 or more and can be easily pressurized. On the other hand, a plasticizer can improve the wettability of a recording medium having a low melt viscosity and a stable fluidity in a molten state.

It is preferable to use an ink having a viscosity of 5 to 30 mPa·s in the ink jet step. Ink dots formed at a viscosity lower than the level as defined above are frequently poor in the edge-sharpness. On the other hand, an excessively high viscosity makes the printing by the ink jet system per se difficult.

As ink materials, use can be made of a number of known solid inks, for example, those disclosed in JP-A-55-54368, JP-A-58-108271, JP-A-61-159470, JP-A-61-141750, JP-A-61-83268, JP-B-62-41112, JP-A-62-48774, JP-A-62-295973, JP-A-64-27953, JP-A-64-295973, JP-A-63-501430, JP-A-2-20661, JP-A-2-229870, JP-A-5-194897, JP-A-5-311101, JP-A-6-107987, JP-A-6-240195, JP-A-6-116521, JP-A-2-281083, JP-A-3-153773, JP-A-4-117468, JP-A-7-70490, JP-A-8-165447, JP-A-9-3377, JP-A-9-71743, JP-A-5-506881, JP-B-4-74193, JP-B-7-115470, etc.

Now, materials of the ink composition to be used in the present invention will be described.

The vehicle to be used in the solid ink of the present invention is not restricted. Namely, it may be composed of one or more components selected from among monoamides, bisamides, tetraamides, polyamides, polyesters, polyvinyl acetate, acrylic and methacrylic polymers, styrene polymers, ethylene/vinyl acetate copolymer, polyketones, silicone, chroman, fatty acids, fatty acid amides, glyceride, natural resins, natural and synthetic waxes, fatty acid ester amides, fatty acid esters, plasticizers, higher alcohols, ketones, etc.

Examples of the tetraamides usable in the present invention include UNIREZ 2224 and UNIREZ 2970 (manufactured by Union Camp). Examples of the polyamides include SYLVAMID E-5 (manufactured by Arizona Chemical), DPX 335-10, DPX H-415, DPX 335-11, DPX 830, DPX 850, DPX 925, DPX 927, DPX 1160, DPX 1163, DPX 1175, DPX 1196, DPX 1358, BASAMIDE 711, BASAMIDE 725, BASAMIDE 930, BASAMIDE 940, BASALON 1117, BASALON 1138 and BASALON 1300 (manufactured by Henkel), TOMIDE 391, TOMIDE 393, TOMIDE 394, TOMIDE 395, TOMIDE 397, TOMIDE 509, TOMIDE 535, TOMIDE 558, TOMIDE 560, TOMIDE 1310, TOMIDE 1396, TOMIDE 90 and TOMIDE 92 (manufactured by Fuji Kasei), etc.

Examples of the polyesters usable in the present invention include KTR2150 (manufactured by Kao), polyvinyl acetate such as AC401, AC540 and AC580 (manufactured by Allied Chemical), silicone such as SILICONE SH6018 (manufactured by Toray Silicone), SILICONE KR215, SILICONE KR216 and SILICONE KR220 (manufactured by Shin-Etsu Polymer), coumarone such as ESCHRON G-90 (manufactured by Nippon Steel Chemical), etc.

As the fatty acid to be used in the present invention, use can be made of, for example, palmitic acid, oleic acid, stearic acid, arachic acid, behenic acid, lignoceric acid, cerotic acid, montanic acid, melissic acid and esters thereof, either alone or as a mixture of two or more thereof.

As the fatty acid amide to be used in the present invention, use can be made of, for example, lauric acid amide, stearic acid amide, erucic acid amide, ricinolic acid amide, stearic acid ester amide, palmitic acid amide, behenic acid amide and brassidic acid amide, etc., either alone or as a mixture of two or more thereof.

As the N-substituted fatty acid amide, use can be made of N,N'-2-hydroxystearic acid amide, N,N'-ethylenebisoleic acid amide, N,N'-xylenebisstearic acid amide, stearic acid monomethylol amide, N-oleylstearic acid amide, N-stearylstearic acid amide, N-oleylpalmitic acid amide, N-stearylerucic acid amide, N,N'-dioleyladipic acid amide, N,N'-dioleylcebacic acid amide, N,N'-distearylisophthalic acid amide, N-stearamide ethyl stearate, etc., either alone or as a mixture of two or more thereof.

As the glyceride, use can be made of rosin ester, lanolin ester, hardened castor oil, partly hydrogenated castor oil, extremely hardened soybean oil, extremely hardened rapeseed oil, extremely hardened vegetable oils, etc., either alone or as a mixture of two or more thereof.

As the wax, selection may be made of petroleum waxes such as paraffin wax and microcrystalline wax, vegetable waxes such as candelilla wax and carnauba wax, special ester waxes and polyethylene wax.

More particularly speaking, use can be made therefor of deodorized and refined CARNAUBA WAX NO.1 and refined CANDELILLA WAX NO. 1 (manufactured by Noda Wax), SYNCHROWAX ERL-C and SYNCHROWAX HR-C (manufactured by Kuroda) and KF2 (manufactured by Kawaken Fine Chemicals). As the special ester wax, it is also possible to use EXEPEARL DS-C2 (manufactured by Kao), KAWASLIP-L and KAWASLIP-R (manufactured by Kawaken Fine Chemicals), etc Moreover, it is possible to use higher alcohol esters of higher fatty acids, for example, myricyl cerotate, ceryl cerotate, myricyl palmitate, myricyl stearate, cetyl plamitate and cetyl stearate.

As the fatty acid ester amide, selection may be made of CPH-380N (manufactured by CP Hall), KAWASLIP SA (manufactured by Kawaken Fine Chemicals), etc.

As the fatty acid ester, it is preferable to use a monohydric or polyhydric alcohol fatty acid ester. For example, use can be made therefor of sorbitan monopalmitate, sorbitan monostearate, sorbitan monobehenate, polyethylene glycol monostearate, polyethylene glycol distearate, propylene glycol monostearate, ethylene glycol distearate, etc. Particular examples thereof include RHEODOL SP-S10, RHEODOL SP-S30, RHEODOL SA10, EMASOL P-10, EMASOL S-10, EMASOL S-20, EMASOL B, RHEODOL SUPER SP-S10, EMANONE 3199, EMANONE 3299 and EXEPEARL PE-MS (manufactured by KAO), UNISTAR M9676 and UNISTAR M2222SL (manufactured by Nippon Oils and Fats).

As the glycerol fatty acid ester, selection may be made of stearic acid monoglyceride, palmitic acid monoglyceride, oleic acid monoglyceride, behenic acid monoglyceride, etc.

Particular examples thereof include RHEODOL MS-50, RHEODOL MS-60, RHEODOL MS-165, RHEODOL Mo-60 and EXEPEARL G-MB (manufactured by Kao).

As the plasticizer, it is preferable to use phosphoric acid esters, phthalic acid esters, aliphatic monochloric acid esters, aliphatic dichloric acid esters, dihydric alcohol esters, oxy-acidesters, chlorinated paraffin, epoxy compounds, etc. For example, selection may be made therefor of tributyl phosphate, tri-2-ethylhexyl phosphate, triphenyl phosphate, tricresyl phosphate, dimethyl phthalate, diethyl phthalate, dibutyl phthalate, diheptyl phthalate, di-n-octyl phthalate, di-2-ethylhexyl phthalate, diisononyl phthalate, octyldecyl phthalate, diisodecyl phthalate, butylbenzyl phthalate, butyl oleate, glycerol monooleate, dibutyl adipate, di-n-hexyl adipate, di-2-hexyl adipate, alkyl 610 adipate, di-2-ethylhexyl azelate, dibutyl sebacate, 2-ethylhexyl sebacate, diethylene glycol dibenzoate, triehtylene glycol di-2-ethylbutylate, methyl acetylricinolate, butylphthalylbutyl glycolate, tributyl acetylcitrate, chlorinated paraffin, chlorinated biphenyl 2-nitrobiphenyl, dinonyl naphthalene, o-and p-toluenesulfone ethyl amide, methyl abietate, etc.

Particular examples thereof include ADEKASIZER (manufactured by Asahi Denka Kogyo), VINISIZER 20, 75, 85, 90 and 105 (manufactured by Kao), KYOWANOL M and D (manufactured by Kyowa Hakko Kogyo), NEWSIZER (Nippon Oils and Fats), SANSOSIZER DUP and DNP (New Japan Chemical), MONOSIZER DBP, DNP and W-540-L (Dainippon Ink and Chemicals), DIASIZER 110, 148, 160, 269, 388, 600-series and 1170 (manufactured by Mitsubishi Chemical Industries), PM-7200T (manufactured by Kawaken Fine Chemicals), etc.

As a coloring agent, it is preferable to use a dye or a pigment which can be well dispersed in the above-described vehicle, has a high heat stability and exerts no undesirable effect on the printing ink in the step of printing. Arbitrary coloring agents such as oily dyes are usable therefor, so long as they are compatible with other ink components.

The coloring agent is added to visualize the ink fixation conditions sp as to facilitate the evaluation. Thus, it is adequate to add the coloring agent in an amount of 0.2 to 5% by weight based on the ink. When the content of the coloring agent is less than 0.2% by weight, the image qualities are deteriorated. When it exceeds 5% by weight, the viscosity properties of the ink are undesirably affected.

It is also possible to appropriately mix two or more coloring agent to thereby adjust the ink color, etc. To impart additional functions to the solid ink, it is furthermore possible to add various surface-treating agents, surfactants, viscosity-lowering agents, antioxidants, preservatives, ultraviolet absorbers, etc. thereto.

With respect to the bending properties of the solid ink having been fixed on the printing master plate, it is favorable that it comes up to the standard level of 5 mmϕ or less, more preferably, 3 mmϕ or less in the mandrel test. When the solid ink satisfies the above requirement, it scarcely peels off even though a printing machine with a small plate drum (for example, not more than 300 mmϕ) is employed. In this case, moreover, a printing master plate with a large size (for example, A3-sheet or larger) can be rolled and carried after printing.

Although the viscosity of an ink can be lowered to an appropriate level by elevating the jet temperature in many cases, an elevated jet temperature causes a problem in the heat stability. As a result, it is feared that the ink is degraded when heated over a long time in an ink reservoir (ink chamber) or in a printing head or it corrodes away a metallic member being in contact therewith. From these points of view, it is the most desirable to regulate the temperature for melting the solid ink in the printing step to 100 to 150+ C. To achieve this condition, it is preferable that the ink has a melting point of from 60 to 100° C., preferably 70° C. or higher. It is also preferable that the volume change accompanying the conversion from the molten state to the solid state is not more than 10%.

The substrate of the printing master plate constructed by using the above-described solid ink may be made of arbitrary materials without restriction. For example, use is frequently made of surface-treated (with kaolin clay,-alumino silicate, etc.) papers, plastic films made of polyester, etc., plastic-laminated papers, metal plates (Zn, Al, stainless, etc.) as specified in JIS H4321, JISH4000, etc., metal-coatedpapers, plastics, etc. In particular, Al metal plates which have been surface-treated by various methods (sand-grinding, electro-chemical treatment or anodization) are employed frequently. It is also possible to coat these substrates with various resins so as to improve the ink acceptability.

Although the present invention has been made on the assumption that the master plate is in the form of a sheet or a plate, it is obvious that an ink dot pattern can be formed directly on a printing drum and then printed as such.

The present invention aims mainly at constructing an offset printing (lithography) master plate. However, modifications will be apparent to those skilled in the art to construct master plates for screen printing, flexo printing, relief printing or gravure printing.

The solid ink is fixed directly onto the substrate. It is also possible to improve the qualities by heating or pressurizing the substrate before, during or after the fixation of the ink. It is also possible for some purposes that the ink is once fixed to another medium and then transferred onto the substrate, as described above.

After the fixation of the solid ink, a common etching treatment may be performed so as to improve the hydrophilic nature of the unfixed parts. In some substrates, it is possible to use an etching agent also serving as a processing liquid for other purposes (PS plate, etc.). Examples of such an etching agent include aqueous solutions of ferric chloride, cupric chloride, ammonium persulfate, etc., chromic acid/sulfuric acid mixture and other solvent-free systems, though the present invention is not restricted thereto. After the completion of this treatment, a mucilage-treatment may be further carried out.

The printing master plate of the present invention is applicable to various printing inks without particular restriction, for example, regular inks, process inks, off-ring inks, metal plate inks, gravure inks, fluorescent inks, metal powder inks, carbon inks, aromatic inks, aqueous inks, UV-hardened inks, IR-dry inks, OCR inks, magnetic inks, resist inks, conductive inks, bar cord inks, temperature-changing inks, gassing inks, liquid crystal inks, inks for medicinal use and transfer printing inks. When a specific printing ink is used, it is needless to say that a solid ink composition appropriate therefor can be selected depending on the solubility parameter, etc.

Moreover, this solid ink is usable in any known ink-jet printers wherein ink droplets are jetted out exclusively when printing is required, for example, printers for office use, printers for industrial marking, wide-format type printers, engraving printers and label printers.

Although citation may be made of papers, plastic films, capsules, gels, metal foils, etc. as examples of the recording medium, the present invention is not restricted thereto but applicable to media over a broad range, since it is usable in non-contact printing.

The present invention will be described in greater detail with reference to the following Examples, but the present invention should not be construed as being limited thereto.

EXAMPLES 1 TO 3 AND COMPARATIVE EXAMPLES 1 AND 2

Rice wax, Japan wax, beeswax, carnauba wax and candelilla wax were provided as a vehicle (each manufactured by Noda Wax), and a mixture of 400 g in weight of 97 parts by weight of each of the waxes and 3 parts by weight of a red dye HSR-31 (manufactured by Mitsubishi Chemical Industries) was heated and kneaded at 130° C. until a homogeneous molten mixture was obtained. Then it was filtered under heating and pressurizing to thereby eliminate impurities, etc. therefrom. Next, the mixture was cooled by allowing to stand at room temperature. Then, five red solid inks were prepared.

Subsequently, these inks were fixed to form a test pattern on an appropriately cut printing plate paper TOYOPLATE DL (manufactured by Xante) by using a solid ink printer JOLT-PS01J (manufactured by Hitachi Koki Co., Ltd.). Further, the papers having the inks fixed thereto were set in an offset printing machine 66IIP (manufactured by Shinohara Shoji) and test printing was carried out. The printing qualities were evaluated by observing pattern failures and irregularity in printing in solid print parts under 10× magnification. Table 1 summarizes the results. In Table 1, the term "parts" stands for "parts by weight".

TABLE 1

| | Ink no. | | | | |
|---|---|---|---|---|---|
| | 1 Ex. 1 | 2 Ex. 2 | 3 Ex .3 | 4 C.Ex. 1 | 5 C.Ex. 2 |
| Rice Wax (parts) | 97 | | | | |
| Japan Wax (parts) | | 97 | | | |
| Beeswax (parts) | | | 97 | | |
| Carnauba wax (parts) | | | | 97 | |
| Candelilla wax (parts) | | | | | 97 |
| HSP-31 (parts) | 3 | 3 | 3 | 3 | 3 |
| Adhesion (g/mm$^2$) strength to printing plate sheet | 35 | 42 | 51 | 20 | 23 |
| Compression stress (kgf/cm$^2$) at strain rate of 10% | 30 | 41 | 35 | 5.1 | 5.6 |
| Penetration | 5 | 22 | 16 | <1 | 1 |
| Melt viscosity (mPa · s) | 12.5 | 7.5 | 8.0 | 12.3 | 10.0 |
| Pattern failure | no | no | no | yes | yes |
| Irregularity in printing in solid part | no | no | no | yes | yes |

The adhesion strength to the printing plate paper and the compression stress at the strain rate of 10% were measured by using STROGRAPH-T (manufactured by Toyo Seiki), the penetration hardness was measured by using a penetration test machine (manufactured by Nikka Engineering) and the viscosity was measured by using a rotational viscometer MODEL EDL (manufactured by Tokimech).

As shown in FIGS. 1 and 2, the adhesion strength to the printing plate substrate was measured as follows. Namely, a test sample was prepared by inserting a solid ink, which had been molten by heating to around the ink jet temperature, between the printing sheets and then spontaneously solidified by cooling. When the substrate per se had a high hardness as in the case of an aluminum plate, etc. and the solid ink and the printing plate material could be maintained in a stable state, the substrate was employed directly. When the substrate per se was unstable in the shape as in the case of a film plate, a paper plate, etc., on the other hand, the substrate was fixed onto a plate made of aluminum, stainless, etc. by using an adhesive, a pressure-sensitive adhesive double coated tape, etc. and then a solid ink was inserted to thereby give a test sample. After the solidification of the solid ink, the test sample was allowed to stand at room temperature over a definite period of time and then employed in the measurement with the use of a tensile compression test device.

Next, samples and measurement conditions will be described in detail.

Figure 2A:
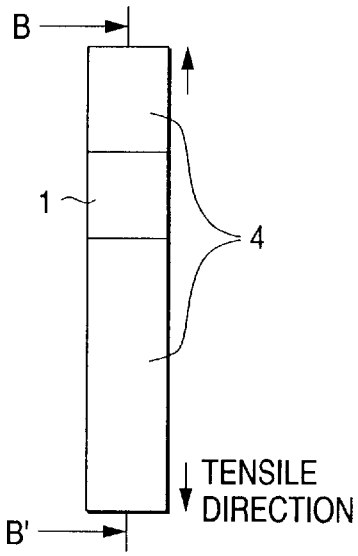
FIGS. 2A and 2B are a schematic plan view and a sectional view showing another tensile test sample employed in the present invention.
Figure 2B:
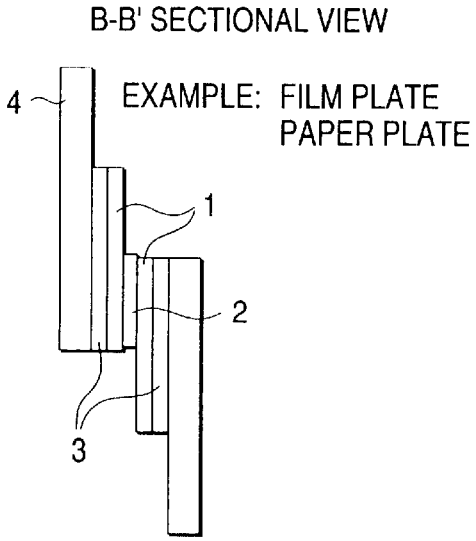

In FIGS. 2A and 2B, a pressure-sensitive adhesive double coated tape (3: NICETACK manufactured by Nichiban) was adhered to an auxiliary plate (4: made of aluminum, etc., 25×130×2 mm). Further, a printing plate paper (1: TOYOPLATE DL manufactured by Xante) being the same in size as the double coated tape. was adhered thereto. After allowing to stand on a hot plate heated to 130° C. for 5 minutes, about 1 cc of a molten solid ink was dropped thereonto. Next, the solid ink (2) was sandwiched by placing the same plate having the printing plate sheet adhered thereto, as shown in FIGS. 2A and 2B. The contact area was 25×30 mm.

This sample was allowed to stand at room temperature for 2 hours or longer and then measurement was made with the use of a tensile compression test device STROGRAPH-T (manufactured by Toyo Seiki) at room temperature (20 to 27° C.) at a crosshead speed of 5 mm/min. The value at which the ink peeled off from the substrate was referred to as the adhesion strength. The measurement was repeated 5 time sand the average was calculated.

The compression stress was measured in the following manner. A solid ink once molten by heating was poured into a cylindrical metal mold and solidified by spontaneously cooling. After allowing to stand at room temperature for 30 minutes, the obtained ink pellet (5) was shaped into a desired test sample (height: 12±1 mm, diameter: 13.5±0.5 mm) by using sand paper P600 (manufactured by KOVAX) as shown in FIG. 3.

This sample was compressed by using a tensile compression test device STROGRAPH-T (manufactured by Toyo Seiki) at room temperature (20 to 27° C.) at a crosshead speed of 5 mm/min. The measurement was repeated 5 times and the average compression stress at each strain rate was determined.

The inks according to the present invention, which had adhesion strength to the printing plate paper of 25 g/mm$^2$ or more, compression stress at strain rate 10% of 10 kgf/cm$^2$ or more and penetration hardness of 3 or more, provided excellent printing qualities free from pattern failure or irregularity in solid parts, compared with the products of Comparative Examples.

EXAMPLES 4 TO 9

A mixture of 48 parts by weight of carnauba wax (manufactured by Noda Wax), 25 parts by weight of a fatty acid ester (UNISTA M9676 manufactured by Nippon Oils & Fats), 20 parts by weight of an alicyclic hydrocarbon (ALKON P-90 manufactured by Arakawa Kagaku), 5 parts by weight of a plasticizer (VINISIZER 85 manufactured by Kao) and 2 parts by weight of a cyanogen dye (Neopen Blue 808 manufactured by BASF) was heated and kneaded at 130° C. until a homogeneous molten mixture was obtained. Then it was filtered under heating and pressurizing to thereby eliminate impurities, etc. therefrom. Next, the mixture was cooled by allowing to stand at room temperature to give a solid ink. Also, inks were prepared by the same procedure as in Example 1 but substituting some of the above components by an aliphatic ester amide (KAWASLIP SA manufactured by Kawaken Fine Chemicals), rosin ester (PINECRYSTAL KE100 manufactured by Arakawa Kagaku) or a plasticizer (DIASIZER 180 manufactured by Mitsubishi Chemicals).

These inks were fixed onto an aluminum substrate (1) as in Example 1 and subjected to a printing test by using an offset printing machine 66IIP (manufactured by Shinohara Shoji). Then evaluation was made in the same manner as in Example 1.

Figure 1B:
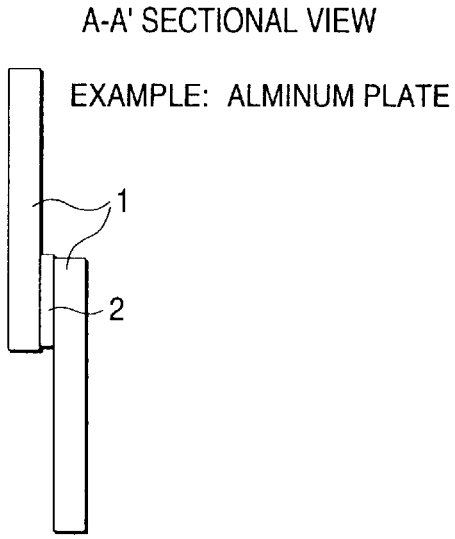

A sample for measuring the adhesion strength was prepared in the following manner. A printing plate substrate (1) (made of aluminum, 25×130×0.3 mm) was allowed to stand on a hot plate heated to 130° C. for 5 minutes. Then about 1 cc of a molten solid ink was dropped thereonto and sandwiched as shown in FIGS. 1A and 1B. The contact area was 25×30 mm. The measurement was made by the same method as in Example 1.

In the compression test, the ink pellet was compressed with the use of a tensile compression test device STROGRAPH-T (manufactured by Toyo Seiki) at room temperature (20 to 27° C.) at a crosshead speed of 5 mm/min, similar to Example 1. The measurement was repeated 5 times and the average compression stress at each strain rate was calculated.

Figure 4:
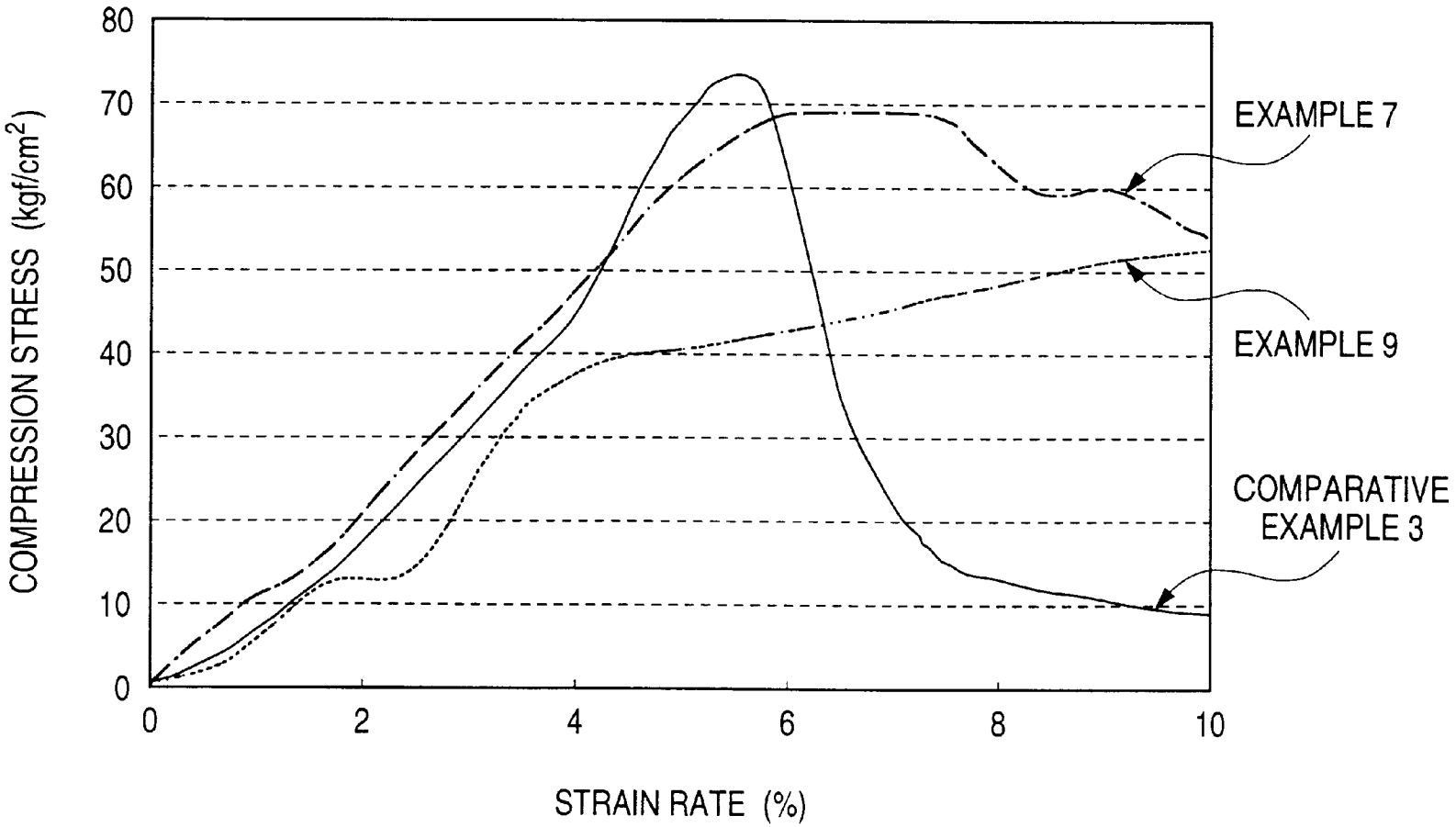
FIG. 4 is a graph showing results of the compression test performed in the present invention.

FIG. 4 shows a typical example of the relation between the strain rate and the compression stress.

In FIG. 4, the samples of Examples 7 and 9 show compression stresses exceeding 50 kgf/cm$^2$ even at the strain rate of 10%. In particular, the sample of Example 9 has no yield value (the point at which the compression stress shows a change from increasing to decreasing with an increase in the strain rate) and no cracking is observed in the ink pellet after the completion of the test. When an ink has no yield value in compression stress until the strain rate at room temperature attains 10% (as in Example 9), or the compression stress at a strain rate of 10% is 10 kgf/cm$^2$ or more, therefore, plate pressure can be relieved in any printing pattern due to the deformation of ink dots per se and the peeling-off of the ink dots can be avoided.

In contrast thereto, the sample of Comparative Example 3 as will be described hereinafter has a yield value at around train rate of 5.5% and shows a compression stress less than kgf/cm$^2$ at a strain rate of 10%. In this case, the ink pellet disrupted after the completion of the test. Therefore, the ling-off of the ink dots cannot be avoided in the case of ink having the characteristics of Comparative Example 3.

Table 2 shows the results of each test. In Table 2, the term "parts" stands for "parts by weight".

TABLE 2

| | Ink no. | | | | | |
|---|---|---|---|---|---|---|
| | 6 Ex. 4 | 7 Ex. 5 | 8 Ex. 6 | 9 Ex. 7 | 10 Ex. 8 | 11 Ex. 9 |
| Carnauba wax (parts) | 48 | 48 | 48 | 35 | | 30 |
| UNISTA M9676 (parts) | 25 | 25 | | 40 | 20 | |
| ALKON P-90 (parts) | 20 | | 20 | | 20 | 20 |
| VINISIZER (parts) | 5 | | 5 | | | 10 |
| KAWSLIP SA (parts) | | 25 | 25 | | 48 | 28 |
| PINECRYSTAL KE100 (parts) | | | | 18 | | |
| DIASIZER 180 (parts) | | | | 5 | 5 | |
| Neopen Blue 808 (parts) | 2 | 2 | 2 | 2 | 2 | 2 |
| Adhesion (g/mm$^2$) strength to printing plate sheet | 63 | 71 | 58 | 106 | 78 | 81 |
| Compression stress (kgf/cm$^2$) at strain rate of 10% | 33 | 26 | 30 | 55 | 43 | 52 |
| Penetration | 7 | 5 | 5.5 | 10 | 12 | 13.5 |
| Melt viscosity (mPa · s) | 10.0 | 10.5 | 10.2 | 8.0 | 9.5 | 7.0 |
| Pattern failure | no | no | no | no | no | no |
| Irregularity in printing in solid part | no | no | no | no | no | no |

EXAMPLES 10 TO 13 AND COMPARATIVE EXAMPLES 3 AND 4

Mixtures of an ester amide (CPH380N manufactured by CP Hall; 98, 78, 58, 40, 20 and 0 parts by weight), carnauba wax (manufactured by Noda Wax; 0. 20, 40, 58, 78 and 98 parts by weight) and 2 parts by weight of a blue dye (Sudan Blue 670 manufactured by BASF) were kneaded while heating to 130° C. until homogeneous mixtures were obtained. Next, the obtained mixtures were filtered under heating and pressurizing to thereby eliminate impurities, etc. therefrom and then cooled by allowing to stand at room temperature. Thus, six black solid inks were prepared.

By using these inks, ink dot test patterns were formed on a printing plate substrate made of aluminum board by using a flat bed type printing plate construction device having with an ink jet head provided with a piezoelectric element. Next, a multi-sheet printing test was performed by using the printing plates obtained above with an offset printing machine and evaluation was made as in Example 1.

The adhesion strength was evaluated as in Example 4 while a compression test was carried out as in Example 1. Table 3 shows the results. In Table 3, the term "parts" stands for "parts by weight".

TABLE 3

| | Ink no. | | | | | |
|---|---|---|---|---|---|---|
| | 12 Ex. 10 | 13 Ex. 11 | 14 Ex. 12 | 15 Ex. 13 | 16 C. Ex. 3 | 17 C. Ex. 4 |
| Ester amide (parts) | 98 | 78 | 58 | 40 | 20 | 0 |
| Carnauba wax (parts) | 0 | 20 | 40 | 58 | 78 | 98 |
| Sudan Blue 670 (parts) | 2 | 2 | 2 | 2 | 2 | 2 |
| Adhesion ($g/mm^2$) strength to printing plate sheet | 35 | 32 | 30 | 27 | 23 | 20 |
| Compression stress ($kgf/cm^2$) at strain rate of 10% | 20 | 18 | 15 | 12 | 8 | 5 |
| Penetration | 6 | 5 | 4 | 3 | 2 | <1 |
| Melt viscosity (mPa · s) | 9.0 | 10.0 | 10.6 | 11.5 | 11.7 | 12.5 |
| Pattern failure | no | no | no | no | yes | yes |
| Irregularity in printing in solid part | no | no | no | no | yes | yes |

EXAMPLES 14 TO 18 AND COMPARATIVE EXAMPLE 5

A solid ink was prepared by kneading a mixture of 60 parts by weight of a monoamide (Kemaide S-180 manufactured by Witco), 18 parts by weight of a. fatty acid ester (RHEODOL MS-50 manufactured by Kao), 14 pasts by weight of a polyamide (SYLVAMID E-5 manufactured by Arizona Chemical), 6 parts by weight of an alicyclic hydrocarbon (ALKON P-100 manufactured by Arakawa Kagaku) and 2 parts by weight of a black dye (Chuo Black 80 manufactured by Chuo GoseI Kagaku) while heating to 130° C. until a homogeneous mixtures was obtained. Next, the obtained mixture was filtered under heating and pressurizing to thereby eliminate impurities, etc. therefrom and then cooled by allowing to stand at room temperature. Also, five solid inks were prepared by using the procedure of Example 1 but substituting some of the above-described components by microcrystalline wax (HiMic 107 manufactured by Nippon Seiro), aplasticizer (PM-7200T manufactured by Kawaken Fine Chemicals) and an alcohol type wax (Unilin 550 manufactured by Petrolite).

These inks were fixed onto printing plate substrates (direct plates mm Oki Data) to form patterns and then a printing test was performed with the use of an offset printing machine (66IIP manufactured by Shinohara Shoji) Next, evaluation was made as in Example 1. Also, the adhesion strength and compression stress were measured by the same methods as those described in Example 1. Table 4 summarizes the results. In Table 4, the term "parts" stands for "parts by weight".

TABLE 4

| | Ink no. | | | | | |
|---|---|---|---|---|---|---|
| | 18 Ex. 14 | 19 Ex. 15 | 20 Ex. 16 | 21 Ex. 17 | 22 Ex. 18 | 23 C.Ex. 5 |
| Kemamide S-180 (parts) | 60 | 50 | 50 | 60 | 60 | 40 |
| RHEODOL MS-50 (parts) | 18 | 10 | 10 | | 10 | |
| SYLVAMID E~5 (parts) | 14 | | 10 | | | |
| ALKON P-100 (parts) | 6 | 20 | | 20 | | 18 |
| HiMic 1070 (parts) | | 18 | | 10 | | |
| PM-7200T (parts) | | | 8 | 8 | 8 | |
| Unilin 550 (parts) | | | 20 | | 20 | 40 |
| Chuo Black 80 (parts) | 2 | 2 | 2 | 2 | 2 | 2 |
| Adhesion ($g/mm^{2)}$ strength to printing plate sheet | 30 | 40 | 58 | 35 | 47 | 24 |
| Compression stress ($kgf/cm^2$) at strain rate of 10% | 35 | 32 | 50 | 20 | 25 | 9 |
| Penetration | 15 | 10.5 | 12.5 | 9.5 | 10 | 2.8 |
| Melt viscosity (mPa · s) | 10.5 | 11.5 | 9.5 | 12.0 | 10.5 | 10.0 |
| Pattern failure | no | no | no | no | no | yes |
| Irregularity in printing in solid part | no | no | no | no | no | yes |

EXAMPLES 19 AND 20

By using the same ink as the one employed in Example 16, a tensile test was performed as in Example 1 with the use of a paper straight master (manufactured by Mitsubishi Chemicals) and KIMOPLATE (manufactured by Kimoto). As a result, adhesion strengths of 82 and 76 $g/mm^2$ were established respectively. Further, ink dot patterns were formed by using the same device as the one employed in Example 1 and a printing test was performed by using an offset printing machine. After printing 3,000 sheets, excellent printing qualities were observed without any pattern failure or irregularity in solid parts.

According to the present invention, it is possible to provide a direct printing plate, which has excellent printing qualities with little peeling-off of ink dots or irregularity in printing even in an image with a high resolution, and a device for constructing a printing plate.

What is claimed is:

1. A solid ink printing master plate comprising:

a substrate; and an ink fixed onto said substrate, wherein said ink has a penetration hardness of 3 or more at room temperature, wherein said ink has a strain rate of 10% for a compression stress of 10 $kgf/cm^2$ or more, and wherein an adhesion strength between said ink and said substrate is 25 $g/mm^2$ or more.

2. The solid ink printing master plate as claimed in claim 1, which is prepared by a method comprising:

heating and liquefying an ink which exists as a solid at room temperature;

ejecting a droplet of said ink; and fixing said droplet of said ink onto said substrate.

3. The solid ink printing master plate as claimed in claim 2, wherein said heating comprises heating said to a temperature of between about 100 and 150 ° C.

4. The solid ink printing master plate as claimed in claim 2, wherein said fixing said droplet of said ink comprises solidifying said ink at room temperature, and wherein when said ink is converted from a liquid to a solid state, said ink has a volume change of not more than 10%.

5. The solid ink printing master plate as claimed in claim 1, wherein said ink has no yield value in compression stress when a strain rate at room temperature is 10% or less.

6. The solid ink printing master plate as claimed in claim 1, wherein said ink contains at least one of a higher fatty acid ester and a plasticizer.

7. The solid ink printing master plate as claimed in claim 1, wherein said plate is for offset rotary press printing.

8. The solid ink printing master plate as claimed in claim 1, wherein said ink is formed directly on said substrate.

9. The solid ink printing master plate as claimed in claim 1, wherein said ink comprises a plurality of ink dots which do not peel during a printing operation.

10. The solid ink printing master plate as claimed in claim 1, wherein said plate is formed on a twin drum roller in an offset printing machine.

11. The solid ink printing master plate as claimed in claim 1, wherein said ink is fixed on said substrate at room temperature.

12. The solid ink printing master plate as claimed in claim 1, wherein said ink comprises at least one of rice wax, Japan wax, beeswax, carnauba wax and candelilla wax.

13. The solid ink printing master plate as claimed in claim 1, wherein said substrate comprises one of aluminum and stainless steel.

14. The solid ink printing master plate as claimed in claim 1, wherein said plate comprises an upper paper plate connected by a pressure-sensitive, double-sided adhesive tape to a lower aluminum plate.

15. The solid ink printing master plate as claimed in claim 1, wherein said ink fixed on said substrate has a bending property of 5 mmϕ or less.

16. The solid ink printing master plate as claimed in claim 1, wherein said ink has a melting point of between about 70 and 100° C.

17. The solid ink printing master plate as claimed in claim 1, wherein said ink comprises a plurality of ink dots corresponding to an image resolution of 300 dpi or more.

18. A method for preparing a solid ink printing master plate, said method comprising:

heating and liquefying an ink which exists as a solid at room temperature;

ejecting a droplet of the ink to a substrate; and fixing said droplet of said ink onto said substrate, wherein a melt viscosity of said ink when ejected is 5 to 30 mPa·s, wherein said ink has a penetration hardness of 3 or more at room temperature, wherein said ink has a strain rate of 10% for a compression stress of 10 $kgf/cm^2$ or more, and wherein an adhesion strength between said ink and said substrate is 25 $g/mm^2$ or more.

19. A solid ink printing master plate comprising:

a substrate; and an ink fixed onto said substrate, wherein said ink has a strain rate of 10% for a compression stress of 10 $kgf/cm^2$ or more, wherein an adhesion strength between said ink and said substrate is 25 $g/mm^2$ or more, and wherein said ink comprises 48 weight percent caranauba wax, 25 weight percent fatty acid ester, 20 weight percent aliphatic hydrocarbon, 5 weight percent plasticizer, and 2 weight percent cyanogen dye.

* * * * *